United States Patent [19]

Imamura

[11] 4,253,083

[45] Feb. 24, 1981

[54] TRAFFIC SIGNAL SYSTEM FOR BLIND PEOPLE

[75] Inventor: Tetsuaki Imamura, Kameyama, Japan

[73] Assignee: Masayuki Hattori, Aichi, Japan

[21] Appl. No.: 886,766

[22] Filed: Mar. 15, 1978

[30] Foreign Application Priority Data

Dec. 19, 1977 [JP] Japan ..... 52-152766

[51] Int. Cl.[3] ..... G08G 1/00

[52] U.S. Cl. ..... 340/44; 340/22; 340/327; 340/328; 116/63 R; 455/234

[58] Field of Search ..... 340/44, 32, 43, 41 R, 340/328, 22, 326, 327, 329; 116/63 R; 325/400; 455/234

[56] References Cited

U.S. PATENT DOCUMENTS 2,260,315 10/1941 Halstead ..... 340/32

3,495,213 2/1970 Nahas ..... 340/32

4,025,922 5/1977 Trawick ..... 340/44

*Primary Examiner*—John W. Caldwell, Sr.

*Assistant Examiner*—Donnie L. Crosland

*Attorney, Agent, or Firm*—Armstrong, Nikaido, Marmelstein & Kubovcik

[57] ABSTRACT

A traffic signal system for blind people which can be combined with an existing traffic signal device the device having a sound signal generator electrically connected to a blue light of the pedestrian traffic signal device for generating a signal representative of imitation sound synchronous with lighting of said blue light, a noise detector, a volume controller for controlling the output of the signal generator in accordance with the detected noise signal of the noise detector, a control gate for preventing the noise signal of said noise detector from being supplied to the volume controller when the generator is on, and a speaker for emitting imitation sound having a volume corresponding to the level of the surrounding noise.

16 Claims, 11 Drawing Figures

TRAFFIC SIGNAL SYSTEM FOR BLIND PEOPLE

BACKGROUND OF THE INVENTION

This invention relates to a traffic signal system for blind people and, more particularly, to such traffic signal system which serves to safely guide blind people by emitting sound such as birds songs and melodious sounds.

Heretofore, such traffic signals for blind people have been arranged so that imitation sound such as birds songs or melodious sounds is emitted at a certain fixed level. Therefore, when the traffic is busy, the imitation sound is masked by the surrounding noise to such an extent that blind persons on the verge of crossing the road experience difficulty in hearing and identifying the signal sound. On the contrary, when the traffic volume and the surrounding noise level go lower, for example, at night the imitation sound becomes highlighted, consequently giving rise to an environmental noise problem of putting great annoyance to those people living near the signal device.

To eliminate such inconvenience, it may be devised to measure the surrounding noise and to produce imitation sound at a proper volume corresponding to the measured noise level. For this purpose, a microphone is used to detect the surrounding noise level so that a speaker may emit sound having a volume proportional to the detected noise level. However, it is sometimes difficult to newly install conductors or cables exclusive to signal devices for the blind to electrically interconnect the signal devices. In these cases, signal devices should independently detect noise and emit imitation sound at a proper volume.

Therefore, an object of this invention is to provide a traffic signal system for blind people in which the volume of signal sound can be controlled in accordance with the surrounding noise level.

Under these conditions, although imitation sound signal generator circuits produce electric sound signals which have the same cycle for all the signal devices located in one direction of a crossing, the actual time of generating imitation sound and the reverberation of speakers may vary from one signal device to another. Also, a substantial time is required for the sound emitted from a speaker of the traffic signal device on one side of the road to propagate through the air and reach the signal device on the opposite side. As a result, the imitation sound emitted from the speaker on one side may be caught by the microphone on the opposite side of the crossing at the beginning of the subsequent quiescent time of imitation sound generation. The signal device which detects the sound originated from the opposite speaker in addition to the surrounding noise to be detected increases its output level. Further, since a large volume of sound emitted from the signal device on one side is accompanied with reverberation having a high sound pressure, the signal device on the opposite side receives this reverberation and thus inevitably and undesirably raises its output level.

Accordingly, another object of the present invention is to provide an improved traffic signal system for blind people, in which a detected surrounding noise signal is fed to an automatic volume control unit with a delay from the instant when an imitation sound signal generator circuit becomes quiescent, so that the volume of imitation sound can be controlled without any disturbance by the imitation sound emitted from other associated signal systems.

BRIEF DESCRIPTION OF THE DRAWINGS

These and other objects and features of the present invention will be understood from the following detailed description of preferred embodiments thereof to be set forth with the accompanying drawings, in which.

EXPLANATION OF PREFERRED EMBODIMENTS

Figure 1:
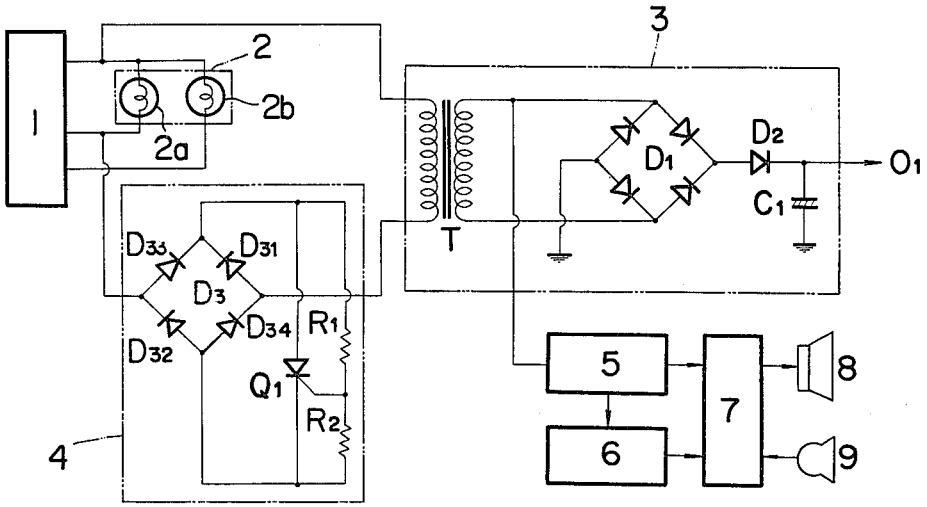
FIG. 1 is a block diagram showing the entire arrangement of a traffic signal system for blind people according to the present invention.

Referring now to the drawings, particularly to FIG. 1, numeral 1 designates a traffic signal control unit of any well-known type which is connected across a signal lighting device 2 exclusively used for pedestrians and a signal lighting device for cars (not shown). The signal lighting device 2 includes blue and red signal lights 2*a* and 2*b*. Across the blue signal light 2*a* is connected a DC circuit 3 which consists of a transformer T, a diode bridge $D_1$, a diode $D_2$ and a smoothing capacitor $C_1$. As seen from FIG. 1, the primary winding of transformer T is connected across the blue signal light 2*a* and the secondary winding is connected across the diode bridge $D_1$. This DC circuit 3 is used to supply electric power to each of pendant circuits constituting the signal system of the invention as described hereinafter. Between one terminal of blue signal light 2*a* and one terminal of the primary winding of transformer T is coupled a malfunction preventing circuit 4 which consists of a diode bridge $D_3$, a thyristor $Q_1$ and resistors $R_1$ and $R_2$. This circuit 4 prevents the signal control unit 1 from malfunctioning due to the reactance of transformer T when the pendant circuits constituting the signal system are driven through the transformer T in electrical circuit with the blue signal light 2*a*. The signal control unit 1 is of the type which uses a triac. To one terminal of the secondary winding of transformer T is connected an imitation sound signal generator circuit 5. The generator circuit 5 is thus energized at the same time as the blue signal light 2*a* is turned on. Two output terminals of the generator circuit 5 are connected to a control gate 6 and an automatic volume control circuit 7, respectively. Since the volume control circuit 7 includes an amplifier and is connected to a speaker 8 at its output, the output signal of the imitation signal generator circuit 5 is amplified through the volume control circuit 7 and emitted from the speaker 8 as a bird song or melodious sound. As explained below, the volume control circuit 7 functions to control the volume of sound to be emitted from the speaker 8 in proportion to the surrounding signal level detected during the preceding quiescent time of imitation sound generation cycles. The control gate 6 connected to the generator circuit 5 and including an inverter is connected to a microphone 9 through the volume control circuit 7. This control gate 6 functions to prevent the output of microphone 9 from being transmitted to the volume control circuit 7 and any other succeeding circuits while the imitation sound signal generator circuit 5 is actuated, thereby eliminating the influence of sound emitted by the traffic signal system itself on volume control.

Figure 3:
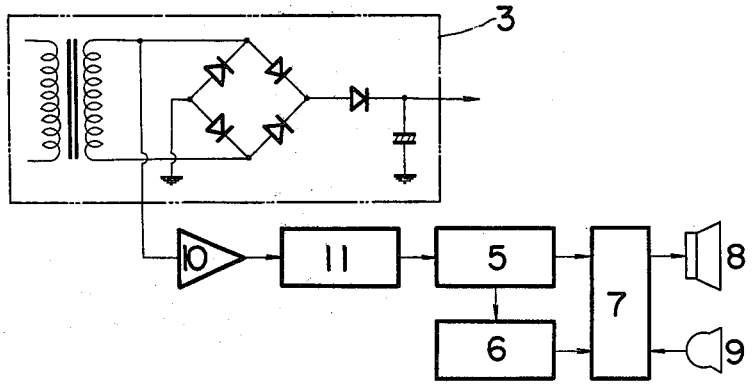
FIG. 3 is a block diagram of an arrangement used for the synchronization of the operation of the traffic signal systems according to the present invention.

Referring now to FIG. 3 in which like numerals denote circuits similar to those shown in FIG. 1, 10 is a waveform shaping circuit which shapes electrical signal appearing on the secondary winding of the transformer T in accordance with the lighting signals fed to the blue signal light 2*a* to generate pulse signals having the same frequency as the source input frequency. 11 is a counter which counts output pulses from the waveform shaping circuit 10 to produce output signals at desirably divided intervals after counting predetermined numbers of pulses. For example, if the signal of the imitation sound signal generator 5 corresponds to a sound "cheap-cheap" of the chick, one cycle of the imitation sound signal generation may comprise a quiescent time of 800 ms and a sound signal generation time of 200 ms. Alternatively, if the signal from the imitation sound signal generator 5 corresponds to a sound "coo-coo" of the cuckoo, one cycle may comprise a 100 ms duration for the first sound "coo", a 300 ms quiescent time, a 200 ms duration for the second sound "coo", and another 900 ms quiescent time, in the described order. The counter 11 counts 50 pulses per second if the source frequency is 50 Hz, and 60 pulses per second for the source frequency of 60 Hz.

Figure 4:
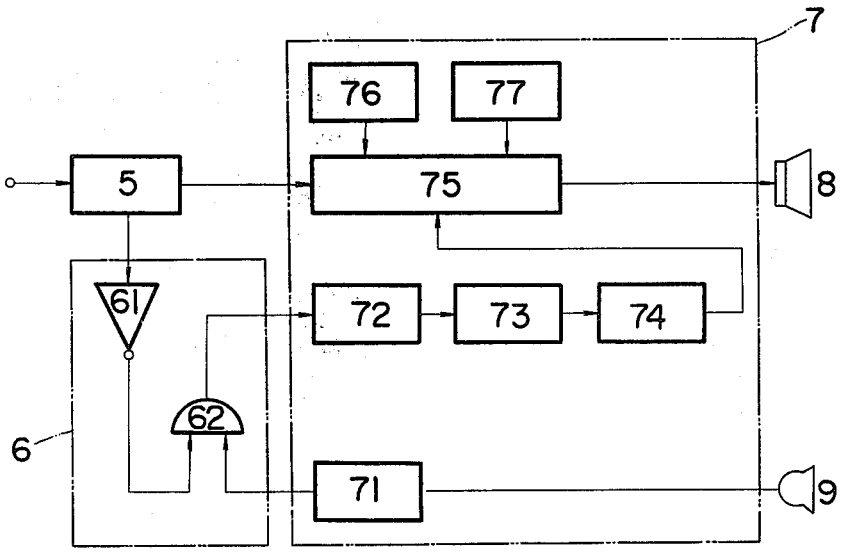
FIG. 4 is a block diagram of a preferred automatic volume control circuit capable of adjusting the volume of imitation sound linearly.
Figure 5:
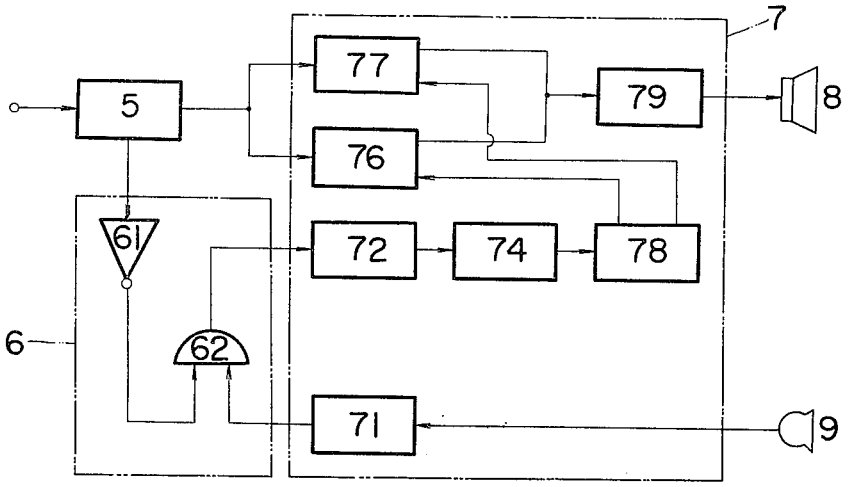
FIG. 5 is a block diagram of another preferred volume control circuit capable of adjusting the volume of imitation sound stepwise.

FIGS. 4 and 5 show in greater detail the control gate 6 and the automatic volume control circuit 7. The control gate 6 comprises an inverter 61 connected to the imitation sound signal generator circuit 5 and an AND circuit 62 having one input connected to the output of the inverter 61 and another input connected to the output of an amplifier 71 to be described later. In FIG. 4, the automatic volume control circuit 7 comprises an amplifier 71 which amplifies the noise signal fed from the microphone 9, a detecting rectifier circuit 72 which detects and rectifies the output signal of AND circuit 62, a DC amplifier 73 which amplifies the DC output of detecting rectifier circuit 72, a delay circuit 74 which stores the output of the amplifier 73, namely noise output in the form of an integrated value, and then outputs the same when a signal is fed from the imitation sound signal generator circuit 5 to the input of a voltage-controlled variable amplifier 75, a voltage-controlled variable amplifier circuit 75 for amplifying the signal fed from imitation sound signal generator circuit 5 in accordance with the output of delay circuit 74, and minimum and maximum value setting circuits 76 and 77 which function together to determine a variable range of the controlled voltage to be applied to the variable amplifier circuit 75.

The imitation sound output is controlled in linear proportion to the noise input in the above preferred embodiment. In another preferred embodiment shown in FIG. 5, the automatic volume control circuit 7 is so arranged that the imitation sound output is controlled stepwise, namely in a two-step changeover scheme on the basis of noise inputs. The volume control circuit 7 in this embodiment includes, in addition to the noise signal amplifier 71, detecting rectifier 72 and delay circuit 74, a comparator 78 having an input connected to the delay circuit 74 and two outputs connected to minimum and maximum value setting circuits 76 and 77, respectively. The parallel circuits 76 and 77 are connected to the imitation sound signal generator circuit 5 and to an amplifier 79. The comparator 78 functions to apply its output to the maximum value setting circuit 77 when the output of delay circuit 74 is at a higher level than a preset value and to apply its output to the minimum value setting circuit 76 when the output of delay circuit 74 is at a lower level than the preset value. The amplifier 79 amplifies the output of the minimum or maximum value setting circuit 76 or 77 so as to drive the speaker 8 at a predetermined higher or lower volume.

Figure 7:
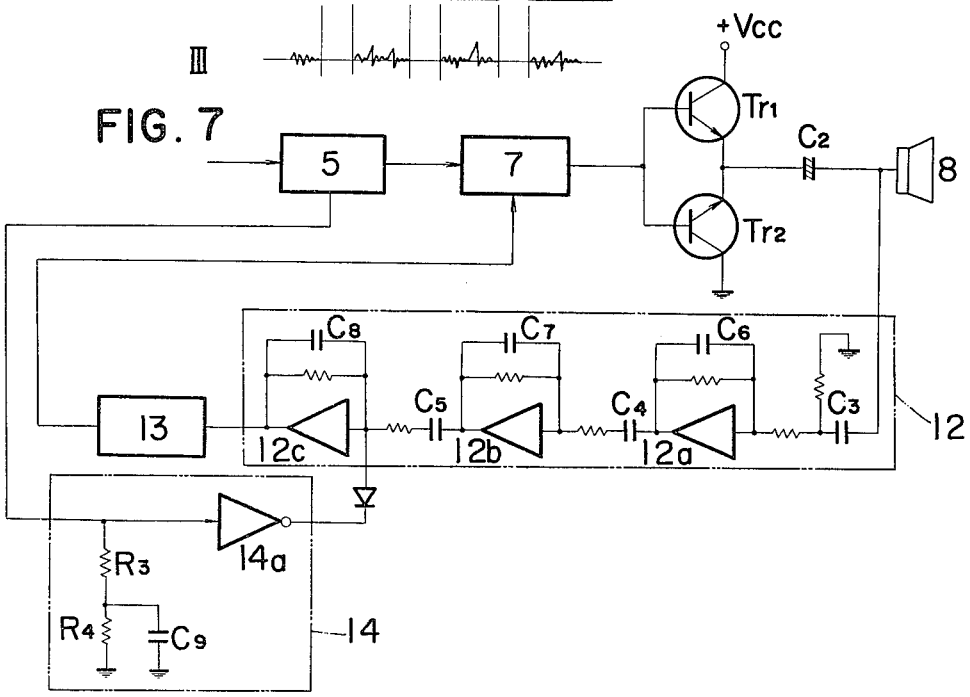
FIG. 7 is a block diagram of another preferred embodiment of the traffic signal system in which a speaker also functions as a microphone.

FIG. 7 shows a circuit arrangement of a speaker and microphone unit. In this embodiment the speaker 8 for converting the signal sent from the imitation sound signal generator circuit 5 into an imitation sound is also used as a microphone for collecting the surrounding noise. Between the volume control circuit 7 and the speaker 8 are inserted parallel connected power transistors $Tr_1$ and $Tr_2$ and a capacitor $C_2$ in series. The capacitor $C_2$ allows a larger power to be fed to the speaker 8 without substantial loss. A block 12 connected to a point between the capacitor $C_2$ and the speaker 8 is an amplifier which corresponds to the amplifier 71 shown in FIGS. 4 and 5. This amplifier 12 for amplifying the signal from the speaker 8 functioning as a microphone includes head, second and third amplifiers $12_a$, $12_b$ and $12_c$ connected in series. Interstage capacitors $C_3$, $C_4$ and $C_5$ attenuate the low-frequency response while capacitors $C_6$, $C_7$ and $C_8$ connected in parallel with the amplifiers $12_a$, $12_b$ and $12_c$, respectively, attenuate the high-frequency response of this circuit. To the output of the amplifier circuit 12 is connected a detecting rectifier circuit 13, similar to the aforementioned rectifier circuit 72, for converting the output of amplifier circuit 12 into a DC signal. The rectifier circuit 13 is connected to the automatic volume control circuit 7 which receives the output voltage of the rectifier circuit 13 as an input. It may be understood that the volume control circuit 7 of this embodiment, for example, includes the circuits 73, 74, 75, 76 and 77 of FIG. 4. A block 14, which corresponds to the aforementioned control gate 6, comprises an inverter 14*a* connected to a point between the amplifier 12*c* and the capacitor $C_8$ and a delay circuit consisting of resistors $R_3$ and $R_4$ and a capacitor $C_9$.

The operation of the traffic signal system for blind people according to the present invention having the circuit arrangements as described hereinbefore will now be described.

Referring again to FIG. 1, if a lighting signal is applied across the blue signal light 2*a*, the corresponding voltage is generated across the secondary winding of transformer T, which is fed to the rectifier means in the DC circuit 3 and then sent out of the output terminal $O_1$ as a driving DC power. A low-voltage AC signal is derived from one terminal of the secondary winding of the transformer T and applied to the imitation sound signal generator circuit 5, which provides a signal representing an imitation sound such as birds songs or melodious sounds. This signal is fed to the automatic volume control circuit 7 and finally emitted from the speaker 8 as an imitation sound. In this circuit arrangement, the noise signal detected by the microphone 9 is cut off through the control gate 6 while the sound signal generator circuit 5 transmits its output signal. The noise signal is available while the circuit 5 does not transmit its output. When an imitation sound signal is subsequently emitted, the volume of this imitation sound to be emitted from the speaker 8 can be controlled by the automatic volume control circuit 7 in proportion to the detected noise level.

Figure 2:
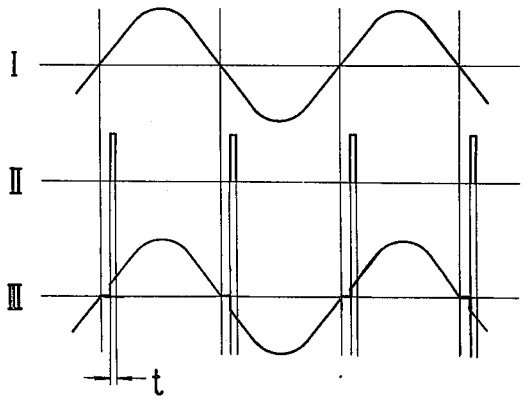
FIG. 2 PRIOR ART
FIG. 2 is a diagram showing source voltage waveforms appearing on the side of an existing traffic signal device to which the traffic signal system according to the present invention is connected.

In recent traffic signal device, null-balance switching using triacs is often employed. If a signal system for blind people is additionally connected to a light switching circuit of the control unit of this type, the reactance of a power transformer in the additional signal system adversely affects a triac used in the switching circuit, rendering the operation of the triac unstable. Accordingly, normal operation of the traffic signal device is disturbed. The influence of transformer reactance on a triac is illustrated in FIG. 2. That is, FIG. 2 is a timing chart showing the operation of a traffic signal device of null-balance switching type using a triac to which the signal system for blind people is connected. Waveform I shows the source voltage to be applied across the triac and waveform II shows triac triggering pulses. Waveform III is the disturbed current which turns on the triac, and shows that the rise of the current is delayed as a result of the connection of the signal system to the triac. This timing chart indicates that unless the current level in waveform III has reached the self-maintaining level until pulses II disappear, the triac will be turned off again to its unstable condition.

In the preferred embodiment shown in FIG. 1, the malfunction preventing circuit 4 is added in order to prevent the existing traffic signal device from malfunctioning due to the addition of this signal system to the usual traffic signal device having triacs connected therein. It is to be noted that the malfunction preventing circuit may be omitted when the traffic signal device uses no triac. Particularly, the malfunction preventing circuit 4 includes a diode bridge $D_3$ with a parallel connection of a thyristor $Q_1$ and resistors $R_1$ and $R_2$. The remaining pair of connections of diode bridge $D_3$ are connected to the blue signal light 2*a* and to the power transformer T. This malfunction preventing circuit 4 operates in the following manner. When AC signal current becomes conductive across the blue signal light 2*a*, the thyristor $Q_1$ is still turned off. When the gate voltage set by resistors $R_1$ and $R_2$ reaches a predetermined value, the thyristor $Q_1$ is turned on to short-circuit the diode bridge $D_3$. Under these conditions, in the negative half-cycle of the source, current flows through a circuit consisting of the primary winding of transformer T, diode $D_{31}$, thyristor $Q_1$ and diode $D_{32}$. In the positive half-cycle of the source, current flows through a circuit consisting of the diode $D_{33}$, thyristor $Q_1$, diode $D_{34}$ and transformer T. The signal system of the invention is thus actuated both in the positive and negative half-cycles of the source.

The application of the source input is prerequisite to turn to the thyristor $Q_1$. This means that the existing traffic signal device must be in normal operation. Further, since the malfunction preventing circuit 4 is open until the thyristor 5 is turned on, the reactance of transformer T in the signal system does not cause a malfunction of the existing traffic signal device.

If two signal systems for blind people of the invention are disposed oppositely in the same direction of a crossing and emit imitation sound independently, each microphone 9 will receive the imitation sound emitted from the speaker 8 of the opposite signal system so that the corresponding automatic volume control circuit 7 may unduly increase its output level due to the increased noise input. Such inconvenience may be avoided by using the circuit arrangement shown in FIG. 3 for synchronizing the operations of imitation sound signal generator circuits 5 of two or more signal systems installed in the same direction of a crossing If power is applied across the blue signal light 2*a* as described with reference to FIG. 1, the transformed low-voltage AC signal is applied to the input of the waveform shaping circuit 10, which in turn outputs a pulse signal at the same frequency as the source input. This pulse signal is applied to the counter 11 which counts input pulses as clock pulses and divides them into periods for transmitting sound signals and quiescent periods in accordance with the requirements for generating a particular imitation sound. Since the imitation sound signal generator 5 is triggered by such synchronous pulses, all the signal systems disposed in the same direction generate imitation sound synchronously or at the same timing and cycle. Thus, the imitation sound generation at those signal systems for the blind disposed in the same direction can be synchronized without adding conductors or cables for synchronization.

FIGS. 4 and 5 show preferred embodiments of the automatic volume control circuit 7 for controlling imitation sound volume in proportion to the detected noise level. Hereinafter, the operation of the automatic volume control circuit 7 will be described, beginning with the first embodiment shown in FIG. 4, which is arranged to change the imitation sound signal output in a linear manner.

The noise signal from the microphone 9 is amplified by the amplifier 71 and then applied to one input of AND circuit 62. However, the AND circuit 62 does not produce its output when the imitation sound generator circuit 5 produces its output, because the inverter 61 does not then produce its output to be applied to the other input of AND circuit 62. During the quiescent time of the imitation sound signal generator circuit 5, the noise signal detected before said quiescent time is passed through the AND circuit 62 because the inverter 61 produces its output. The output signal of AND circuit 62 is converted by the detecting rectifier circuit 72 into a DC voltage varying in proportion to the microphone input. The DC voltage is amplified by the DC amplifier 73, and integrated and stored in the delay circuit 74. When an imitation sound signal is subsequently fed from the sound signal generator 5 to the voltage-controlled variable amplifier circuit 75, it is amplified in proportion to the stored voltage level within a range between the minimum and maximum set in circuits 76 and 77, and then fed to the speaker 8, which emits imitation sound.

In the second preferred embodiment of the automatic volume control circuit 7 shown in FIG. 5, steps of amplifying the signal from the microphone 9 by the amplifier 71, obtaining a DC voltage in the detecting rectifier circuit 72, and storing said voltage in the delay circuit 74 are identical to those in the first embodiment shown in FIG. 4. However, in the second embodiment the DC voltage output of delay circuit 74 is fed to the input of a comparator circuit 78. A reference with which any input is compared is preset in the comparator circuit 78. If the input voltage is higher than the reference, a gating signal is assigned to the maximum value setting circuit 77 to actuate the circuit 77. If the input voltage is lower than the reference, a gating signal is assigned to the minimum value setting circuit 76 to actuate the circuit 76. The output of either of these setting circuits is transmitted through the amplifier 79 to the speaker 8.

Figure 6:
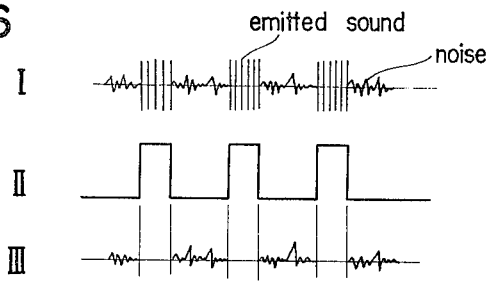
FIG. 6 is a chart illustrating the removal of imitation sound generated by the traffic signal device itself from the surrounding noise.

In the timing chart of FIG. 6, curve I shows a waveform consisting of imitation sound signals and surrounding noise signals alternately caught by the microphone 9 and waveform II shows a signal applied by the sound generator circuit 5 to the control gate 6. Due to the presence of inverter 61 and AND circuit 62, the signal II functions as a suppression signal so that waveform III appears at the output of control gate 6.

The description will now be made on the operation of the circuit arrangement shown in FIG. 7 in which the speaker 8 also functions as a microphone.

Figure 8:
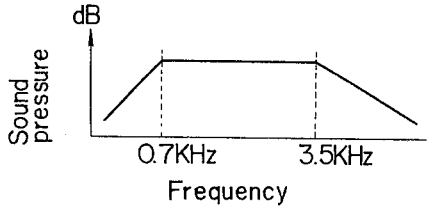
FIG. 8 is a frequency response of a preferred speaker used in the system of FIG. 7.

When power is applied across the blue signal light 2*a*, the imitation sound signal generator circuit 5 generates the imitation sound signal. At the same time, and only during the period of transmitting said imitation sound signal, the control gate 14 cuts off the signal from the speaker 8 functioning as the microphone. That is to say, since the automatic volume control circuit 7 is not actuated initially, the volume is controlled to minimum by means of the minimum value setting circuit 76. The output of the circuit 7 based on said setting of the circuit 76 is amplified through transistors $Tr_1$ and $Tr_2$ and fed to the speaker 8 as an electric sound signal. When sound signal transmission is interrupted, the speaker 8 receives no driving signal and, thus functions to catch the surrounding noise to provide an electric signal in proportion to the detected noise level. At this time, with the transistors $Tr_1$ and $Tr_2$ cut off, the power amplification system including the capacitor $C_2$ is in open circuit condition, permiting the electric signal representative of the noise caught by the speaker 8 to be supplied to the head amplifier 12*a* without a loss. In the head, second and third amplifiers 12*a*, 12*b* and 12*c*, each of the capacitors $C_6$, $C_7$ and $C_8$ is connected in parallel to a feedback resistor to attenuate the high frequency response of the circuit. Further, the interstage capacitors $C_3$, $C_4$ and $C_5$ have so small a capacitance as to attenuate the low frequency response of the circuit. This combination provides the AC amplifier circuit (consisting of head, second and third amplifiers 12*a*–12*c*) with a filtering effect for the overall frequency range. In order to obtain a sufficient filtering effect and to improve the overall frequency response, it is desirable that the speaker 8 has a flat frequency response over a restricted audible frequency range as shown in FIG. 8. This type of speaker (microphone) is useful to eliminate high- and low-frequency noises which would otherwise adversely affect the automatic volume control function, and to efficiently amplify electric noise signals within a band width of 1 kHz to 3 kHz which is best suited for the detection of noise level.

Figure 9:
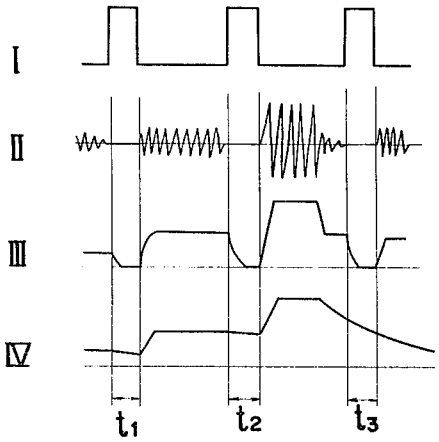
FIGS. 9 and 10 are charts of waveforms of noise signals used to control the volume control circuit of the traffic signal systems according to the present invention.

Reference should now be made to FIG. 9. When the imitation sound signal shown by waveform I in FIG. 9 is generated by the generator circuit 5, the control gate 14 is turned off to interrupt the amplification in the third amplifier 12*c* and the succeeding elements. With no signal from the generator circuit 5, the third amplifier 12*c* produces an output having waveform II in FIG. 9 and representing the surrounding noise. This output is converted through the detecting rectifier circuit 13 into a DC voltage signal having waveform III in FIG. 9. If this DC signal is used to control the automatic volume control circuit 7, automatic volume control cannot be effected because the controlling DC signal goes down to O volt during interruption periods $t_1$, $t_2$, $t_3$, etc., namely when imitation sound signals are generated. Therefore, this DC signal must be stored or retained for a certain period of time. Then, passing the DC signal through the delay circuit will produce a signal having waveform IV in FIG. 9. As a result, controlling DC signals are obtained in interruption periods $t_1$, $t_2$, $t_3$, etc. Further, by providing for about a one second delay before the rise and after the fall, instantaneous or temporary noises can be eliminated. Consequently, the operation of automatic volume control circuit 7 is smoothed and the sound which has once increased in volume can entail comfortable reverberation.

Since the delay circuit consisting of resistor $R_3$ and capacitor $C_9$ (with a time constant of about 100 ms) is connected to the control gate 14, the microphone of the same system does not detect the imitation sound emitted from the opposite signal system disposed in the same direction of a crossing.

Figure 10:
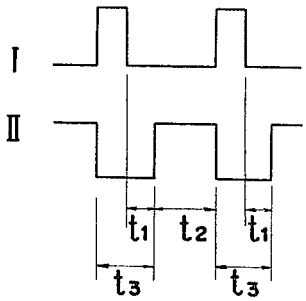

In the case of roads having a width of 8 m or so, the time constant of 100 ms is sufficient to avoid the overlapping of the imitation sound emitted from the speaker of the opposite signal system which would otherwise be caught by the microphone 8 and transmitted to the third amplifier 12*c* and the succeeding stages, because it takes about 24 ms for imitation sound to reach the microphone 8 from the speaker of the opposite signal device spaced 8 m apart. The time constant of 100 ms means that any synchronous signal sound coming from a point spaced apart from the relevant microphone up to about 34 m can be shut out. This relationship is illustrated in the chart of FIG. 10, in which waveforms I and II show input and output signals of the control gate 14, respectively, with $t_1$ indicating a delay time (100 ms), $t_2$ indicating a noise detecting period, and $t_3$ indicating the overall amplification interrupting period. If one signal device is 34 m or more spaced apart from the opposite signal device, the imitation sound emitted by said opposite signal device at 90 dB/m will be attenuated to about 60 dB/m when it reaches the microphone 8 of the one signal device. The attenuated sound will not be at a higher level than the surrounding noise level, therefore noise problems do not arise.

In the aforementioned preferred embodiments, two types of automatic volume control circuits have been disposed. Namely, the volume of signal sound is linearly controlled in the first embodiment, while the volume is controlled stepwise to maximum and minimum levels in the second embodiment. However, it is to be noted that volume can be controlled in more steps by providing a plurality of comparator circuits 78.

Figure 11:
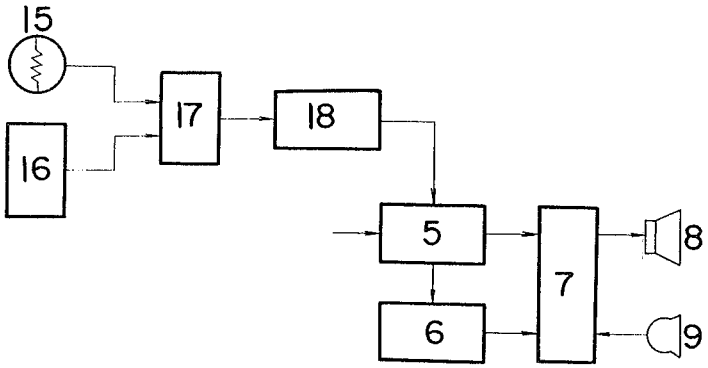
FIG. 11 is a block diagram of an arrangement for switching the traffic signal system in terms of light.

FIG. 11 shows a circuit arrangement for switching the signal system for blind people at night and in the morning. A photoelectric element 15 made of CdS or other photosensitive material for sensing the surrounding light and a temperature sensor 16 in the form of a thermistor for detecting the ambient temperature are both connected to an operational means 17 which is connected to an electronic timer 18. It may be assumed that the sun rises at about 4:30 a.m. and sets at about 7:00 p.m. in summer and rises at about 6:30 a.m. and sets at about 5:00 p.m. in winter in the area where the traffic signal is installed. The annual average temperature at 6:00 p.m. which is an average of annual sunset hours and the annual average temperature at 5:30 a.m. which is an average of annual sunrise hours may be stored in the operational means 17. When the photosensor 15 detects that the surrounding light reaches a predetermined level of illumination, the output of temperature sensor 16 is compared with the stored data. The operational means 17 can determine a time to be set for the timer 18 as a result of such comparison.

More illustratively, when the photosensor 15 detects that the surrounding light becomes dim below the predetermined limit of illumination, the actual ambient temperature detected by the temperature sensor 16 at this instant is compared with the preset temperature in the operational means 17. If the ambient temperature is higher than the preset level, a correspondingly reduced time is set in the timer 18, and vice versa. Accordingly, the timer may be always set to 10:00 p.m. throughout the year. The imitation sound signal generator circuit 5 may be rendered inoperative during midnight. In a similar manner, the generator circuit 5 may be enabled at a suitable hour in the morning.

It should be noted that these elements can be arranged so that the level of sound output may be reduced or increased when the surrounding light reaches the predetermined level of illumination.

What is claimed is:

1. A traffic signal system for blind people installed in combination with a common traffic signal device for pedestrians, comprising a signal generator circuit electrically coupled to a blue light of the pedestrian traffic signal device for generating an audible sound signal synchronous with lighting of said blue light, a noise detector circuit for detecting the surrounding noise, a volume control circuit connected to said signal generator circuit and said noise detector circuit for controlling the output of said signal generator circuit in accordance with the output of said noise detector circuit, and a speaker electrically connected to said volume control circuit, whereby an audible sound having a volume corresponding to the level of the surrounding noise is produced from the speaker.

2. A traffic signal system for blind people according to claim 1, which further comprises a control gate coupled between said generator circuit, detector circuit and volume control circuit for cutting off the output of said noise detector circuit when said signal generator circuit produces a signal and for applying said output to said volume control circuit when said signal generator circuit produces no signal.

3. A traffic signal system for blind people according to claim 2, wherein said control circuit includes a delay circuit, thereby applying the output of said noise detector circuit to said volume control circuit with a delay after said signal generator circuit is interrupted.

4. A traffic signal system for blind people installed in combination with a common traffic signal device for pedestrians comprising an imitation sound signal generator circuit electrically coupled to a blue light of the pedestrian traffic signal device for generating an imitation sound in accordance with lighting of said blue light, a noise detector circuit for detecting the surrounding noise to give a noise signal, a volume control circuit connected to said signal generator circuit and said noise detector circuit for controlling the output of said signal generator circuit in accordance with the level of the detected noise signal, said volume control circuit including a delay circuit, a control gate coupled between said signal generator circuit, detector circuit and volume control circuit for cutting off the output of said noise detector circuit when said signal generator circuit produces a signal and for applying the output to said volume control circuit when said signal generator circuit produces no signal, and a speaker electrically connected to said volume control circuit for emitting imitation sound, whereby the output of said noise detector circuit is applied to said volume control circuit with a delay after said signal generator circuit is interrupted.

5. A traffic signal system for blind people according to claim 2, which further comprises a pulse generator circuit inserted between said blue light and said signal generator circuit for generating pulses having the same frequency as the power supply source to said blue light, and a counter connected between said pulse generator and signal generator circuits, said counter receiving pulses from said pulse generator circuit as clock pulses to divide them into actuation and interruption periods of a cycle required for the generation of sound signal.

6. A traffic signal system for blind people according to claim 2, wherein the output terminal of said volume control circuit and the input terminal of said noise detector circuit are interconnected and said speaker is connected to said interconnection and is also used as a microphone.

7. A traffic signal system for blind people according to claim 2, wherein said volume control circuit includes means for amplifying the output of said signal generator circuit in proportion to the output of said noise detector circuit.

8. A traffic signal system for blind people according to claim 2, wherein said volume control circuit includes means for amplifying the output signal of said signal generator circuit stepwise in accordance with the output of said noise detector circuit.

9. A traffic signal system for blind people according to claim 7, wherein said volume control circuit further includes a rectifier, a delay circuit and maximum and minimum value setting circuits, whereby the noise signal detected when said signal generator circuit is interrupted is converted into a DC voltage and stored in said delay circuit, and a sound signal subsequently transmitted by said signal generator circuit is amplified within the range defined by said maximum and minimum value setting circuits in proportion to the output signal of said delay circuit.

10. A traffic signal system for blind people according to claim 8, wherein said volume control circuit further includes a rectifier, a delay circuit and maximum and minimum value setting circuits, whereby the noise signal detected when said signal generator circuit is interrupted is converted into a DC voltage and stored in said delay circuit, and a sound signal subsequently transmitted by said signal generator circuit is amplified within the range defined by said maximum and minimum value setting circuits in accordance with the output signal of said delay circuit.

11. A traffic signal system for blind people according to claim 1, wherein the traffic signal device is of a null-balance switching type, said traffic signal system is connected to the blue light of said traffic signal device by way of a transformer, and said traffic signal system further includes a malfunction preventing circuit connected between said blue light and transformer.

12. A traffic signal system for blind people according to claim 11, wherein said malfunction preventing circuit comprises a diode bridge having a pair of connections connected to the primary winding of said transformer and to the blue light, and a thyristor connected between another pair of connections of said diode bridge, whereby a short-circuit is established across the diode bridge, when said thyristor is turned on, permitting the source voltage to be applied across the transformer.

13. A traffic signal system for blind people according to claim 1, which further includes measuring means for measuring the surrounding light to start or terminate the operation of said traffic signal system when the surrounding light reaches a predetermined level of illumination.

14. A traffic signal system for blind people according to claim 1, which further includes measuring means for measuring the surrounding light to reduce or increase the level of sound output when the surrounding light reaches a predetermined level of illumination.

15. A traffic signal system for blind people according to claim 13 or 14, wherein said measuring means is in the form of a photoconductive cell having an output coupled to said signal generator circuit.

16. A traffic signal system for blind people according to claim 13, which further includes a timer means electrically connected to said light measuring means and said signal generator circuit, whereby the operation of said traffic signal system is started or terminated with a delay set by said timer means after the surrounding light reaches the predetermined level of illumination.

* * * * *